US010251471B1

(12) United States Patent
Sanderson

(10) Patent No.: US 10,251,471 B1
(45) Date of Patent: Apr. 9, 2019

(54) PORTABLE SCRUBBING AND CLEANING DEVICE WITH INTERCHANGEABLE BRUSH AND CLEANING SOLUTION CYLINDER

(71) Applicant: Clint Sanderson, Newalla, OK (US)

(72) Inventor: Clint Sanderson, Newalla, OK (US)

( * ) Notice: Subject to any disclaimer, the term of this patent is extended or adjusted under 35 U.S.C. 154(b) by 0 days.

(21) Appl. No.: 15/973,913

(22) Filed: May 8, 2018

Related U.S. Application Data

(63) Continuation-in-part of application No. 15/005,401, filed on Jan. 25, 2016, now abandoned.

(60) Provisional application No. 62/110,218, filed on Jan. 30, 2015.

(51) Int. Cl.
*A46B 11/00* (2006.01)

(52) U.S. Cl.
CPC ..... *A46B 11/0017* (2013.01); *A46B 11/0006* (2013.01); *A46B 2200/3046* (2013.01); *A46B 2200/3073* (2013.01)

(58) Field of Classification Search
CPC ..... A46B 11/0017; A46B 11/0006; A46B 2200/3073; A46B 2200/3046; A46B 11/00; A46B 11/001; A46B 11/002; A46B 11/0062; A46B 11/0065; B05C 17/00569; B05C 17/00573; B05C 17/00596
See application file for complete search history.

(56) References Cited

U.S. PATENT DOCUMENTS

| | | | | |
|---|---|---|---|---|
| 1,810,544 | A | 6/1931 | Trupiano | |
| 3,008,164 | A | 11/1961 | Herman et al. | |
| 3,184,781 | A | 5/1965 | Hoxie | |
| 4,372,700 | A | 2/1983 | Moffitt, Jr. | |
| 4,533,273 | A | 8/1985 | Obata et al. | |
| 4,557,619 | A | 12/1985 | DeVincentis | |
| 4,753,547 | A | 6/1988 | Dodero | |
| 4,789,261 | A | 12/1988 | Iwase et al. | |
| RE33,860 | E | 3/1992 | Chen | |
| 5,234,136 | A * | 8/1993 | Kopis | A45D 40/02 222/391 |
| 5,791,801 | A | 8/1998 | Miller | |
| 6,170,108 | B1 | 1/2001 | Knight | |
| 6,210,064 | B1 | 4/2001 | White et al. | |
| 6,325,564 | B1 | 12/2001 | Knowles | |

(Continued)

FOREIGN PATENT DOCUMENTS

WO 0172382 10/2001

OTHER PUBLICATIONS

Amazon.com, "Gogo Club Scrup Wet Cleaning Brush for Golf Clubs; printed from Amazon.com on Apr. 15, 2016", "http://www.amazon.com/GOGO-Scrub-Cleaning-Brush-Clubs/dp/B00JFLH724".

(Continued)

*Primary Examiner* — David J Walczak
(74) *Attorney, Agent, or Firm* — Gable Gotwals

(57) ABSTRACT

Embodiments of a portable scrubbing and cleaning device of this disclosure include a rounded brush head to make the device ergonomically friendly no matter how a user holds it; sliding bottle inside of a main body or housing with a cap on one end for quick and easy refilling of cleaning solution; fins on the inside of main body and slots on the bottle so as to not allow the bottle from spinning when the cap is being screwed or unscrewed; and a diamond cut, knurled finish on main body for a sure grip.

8 Claims, 5 Drawing Sheets

(56) References Cited

U.S. PATENT DOCUMENTS

| | | | | |
|---|---|---|---|---|
| 6,406,207 | B1 * | 6/2002 | Wiegner | A46B 11/0027 401/272 |
| 6,685,375 | B1 | 2/2004 | Crocker | |
| 6,983,866 | B2 | 1/2006 | Smart et al. | |
| 7,040,830 | B2 | 5/2006 | Kliegman et al. | |
| 7,101,107 | B1 * | 9/2006 | Byun | A45D 34/042 401/286 |
| 7,682,097 | B2 | 3/2010 | Knopow et al. | |
| 7,784,149 | B2 | 8/2010 | Schwarz et al. | |
| 8,016,508 | B2 | 8/2011 | Byun | |
| 8,152,400 | B2 | 4/2012 | LaFlamme et al. | |
| 8,360,668 | B1 | 1/2013 | Hinnant | |
| 8,708,591 | B2 | 4/2014 | Shepard, Jr. | |
| 8,740,488 | B2 | 6/2014 | Cable et al. | |
| 8,888,395 | B1 | 11/2014 | Hinnant | |
| 9,212,039 | B1 | 12/2015 | Reidy et al. | |
| 2001/0052353 | A1 | 12/2001 | Brumlik | |
| 2003/0059247 | A1 | 3/2003 | Kandasamy et al. | |
| 2004/0140326 | A1 | 7/2004 | Smart et al. | |
| 2004/0265042 | A1 | 12/2004 | Chan et al. | |
| 2005/0069375 | A1 | 3/2005 | Kliegman et al. | |
| 2009/0003922 | A1 | 1/2009 | Sampaio | |
| 2009/0320224 | A1 | 12/2009 | Hohlbein et al. | |
| 2010/0067972 | A1 | 3/2010 | Ashworth et al. | |
| 2011/0197917 | A1 | 8/2011 | Koptis et al. | |
| 2015/0101630 | A1 | 4/2015 | Kodama | |
| 2016/0015224 | A1 | 1/2016 | Harewood | |

OTHER PUBLICATIONS

Amazon.com, "ProActive Groove Tube Squeeze Bottle Groove Cleaner; printed from Amazon.com on Apr. 15, 2016", "http://www.amazon.com/ProActive-Groove-Squeeze-Bottle-Cleaner/dp/B002IJ5VSW".

Amazon.com, "TeeMate Club Scrub Wet Cleaning Brush for Golf Clubs; printed from Amazon.com on Apr. 15, 2016", "http://www.amazon.com/TeeMate-Cleaning-Easily-Solution-Action/dp/B008YM3TEK/ref=pd_sim_sg_3?ie=UTF8&refRID=1M1XS9JC7KBSD5PCEFV4".

* cited by examiner

PORTABLE SCRUBBING AND CLEANING DEVICE WITH INTERCHANGEABLE BRUSH AND CLEANING SOLUTION CYLINDER

CROSS-REFERENCE TO CO-PENDING APPLICATIONS

This application claims priority to U.S. Ser. No. 15/005,401 filed Jan. 25, 2016 and now abandoned, which in turn claims priority to U.S. 62/110,218 filed Jan. 30, 2015, the contents of which are hereby incorporated by reference.

BACKGROUND

This disclosure generally relates to portable scrubbing and cleaning devices intended to clean household, sporting goods, and consumer products such as barbecue grates, golf clubs, and automotive wheels. More particularly, the disclosure relates to portable scrubbing and cleaning devices which permit interchangeable brush heads and cleaning solution canisters within the same device.

An example of a prior art scrubbing and cleaning devices is golf club head cleaners which have a brush built-in at the spout of the container which holds the cleaning solution. The container is typically a squeeze bottle and the cleaning solution is dispensed under pressure by the user squeezing the bottle (see e.g. GOGO CLUB SCRUB™ brush, PRO-ACTIVE GROOVE TUBE™ brush, and TEEMATE CLUB SCRUB™ brush). If the brush wears out, the user can no longer use the brush or the container.

Other cleaners make use of a spray bottle or aerosol can arrangement that permits the brush to be attached to the bottle or can (see e.g. U.S. Pat. Nos. 3,008,164 and 8,708,591). In these cleaners, the brush cannot be connected to the top end of the bottle or can so that the cleaning solution is delivered directly through the brush. Instead, the brush is used separately from the bottle or can.

WO 2001/072382 A1 to Murray discloses a cap that can receive a golf ball and be attached to the nozzle end of an aerosol can. The cap is arranged so the ball is freely rotatable within the cap and the cap, which can include bristles, includes an aperture so that a user's finger can actuate the nozzle.

SUMMARY

Embodiments of a portable scrubbing and cleaning device of this disclosure include a cylindrical-shaped housing that has a threaded uppermost end, a top cap threaded for connection to the housing and having a brush and a cleaning solution passageway in communication the brush, and an actuator located at a lowermost end of the housing and arranged to move between a non-deployed and a deployed position. The actuator has a pocket that receives the bottom end of an aerosol canister and a button end that extends past the lowermost end of the housing. A bottom cap retains the actuator in the housing. When the actuator is in the deployed position, the linear distance between the actuator and the top cap decreases, thereby causing an aerosol canister housed by the housing to release its cleaning solution through the cleaning solution passageway and onto the brush. Because of this arrangement, a user does not have to touch the nozzle end of the canister.

Other embodiments of a portable scrubbing and cleaning device of this disclosure include a cylindrical shaped housing with threaded uppermost and lowermost ends, a top cap that has a brush and is threaded for connection to the uppermost end of the housing, a bottom cap threaded for connection to the lowermost end of the housing, and a spray bottle sized to fit within the housing. The spray bottle has a reservoir for cleaning solution, an upper end that is sealed with a spray pump, and a lower end that is sealed with a spray bottle cap which extends through an opening in the bottom cap when the device is assembled. A first portion of the spray pump extends into the reservoir of the spray bottle and a second portion of the spray pump extends through the top cap into the brush to form a cleaning solution passageway. In order to move between non-deployed and deployed positions, a user presses on the spray bottle cap. The linear distance between the spray bottle cap and the top cap is less in the deployed position than in the non-deployed position, thereby forcing cleaning solution from the reservoir through the cleaning solution passageway and onto the brush.

In embodiments, a portable scrubbing and cleaning device includes an elongated, cylindrical housing including a threaded uppermost end, an open lowermost end, and at least one fin located along an inner sidewall of the housing. An elongated, cylindrical shaped canister is contained within the housing, the canister including a cleaning solution reservoir and at least one slot located along an outer sidewall of the canister and sized to receive the at least one fin of the housing. A top cap is threadably connected to the threaded uppermost end of the housing, the top cap including an arcuate-shaped top end containing a brush extending up and away from the top cap and a cleaning solution passageway in fluid communication with the brush and an upper end of the canister. An actuator at least partially contained within the open lowermost end of the housing and is arranged to move the cleaning solution canister toward the top cap. A linear distance between the actuator and the top cap being greater when the actuator is in a non-deployed position than when in a deployed position. The canister may further include a spray pump located at the upper end of the cleaning solution canister, the spray pump at least partly contained within the top cap. The lower end of the canister may be threaded, with the actuator including a threaded cap connectable to this lower end.

LISTING OF ELEMENTS USED IN THE DRAWINGS

Figure 1:
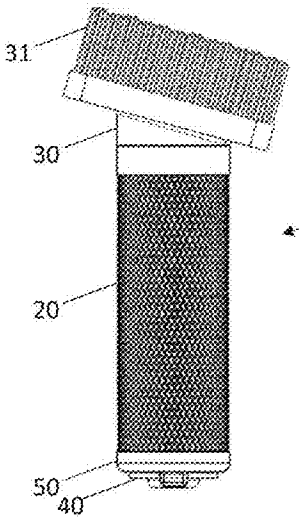
FIG. 1 is a front elevation view of an embodiment of a portable scrubbing and cleaning device when in an assembled state.

10 Portable scrubbing and cleaning device
11 Central longitudinal axis
20 Cylindrical-shaped housing
21 Uppermost end
23 Lowermost end
25 Inner sidewall
26 Fin
27 Eyelet
29 Ring
30 Top cap
31 Brush
33 Bed or central block of brush
35 Cleaning solution passageway
37 Lower end of 35
40 Actuator (piston)
41 Button end
43 Pocket
45 Linear distance between 30 and 40
50 Bottom cap (or bottom end of 20)
51 Opening
60 Aerosol canister
61 Nozzle end
63 Bottom end
65 Bottom cap
67 Spray bottle
69 Reservoir
71 Channel, groove, or slot
73 Upper end of spray bottle
75 Spray pump
77 Lower end of spray bottle
79 Spray bottle cap
85 Outer sidewall

DETAILED DESCRIPTION

Embodiments of a portable scrubbing and cleaning device of this disclosure include a rounded or arcuate-shaped brush head to make the device ergonomically friendly no matter how a user holds it; sliding bottle inside of a main body or housing with a cap on one end for quick and easy refilling of cleaning solution; fins on the inside of main body and slots on the bottle so as to not allow the bottle from spinning when the cap is being screwed or unscrewed; and a diamond cut, knurled finish on main body for a sure grip.

Figure 2:
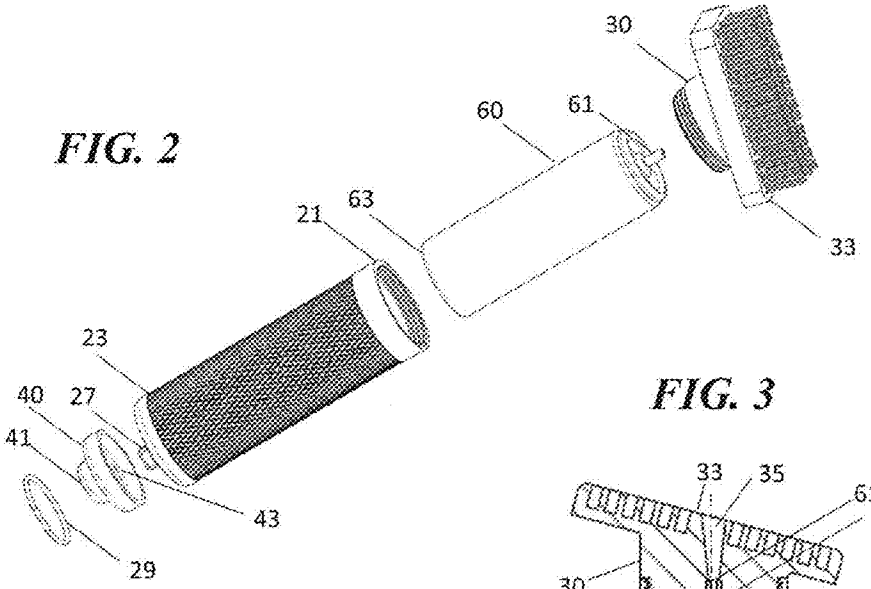
FIG. 2 is an exploded assembly view of the device of FIG. 1.
Figure 3:
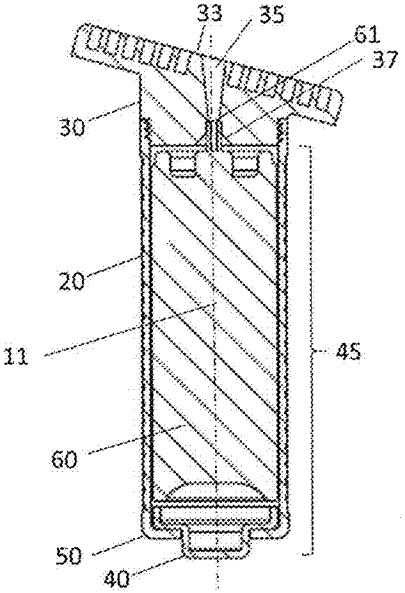
FIG. 3 is a cross section view of the device of FIG. 1.
Figure 4:
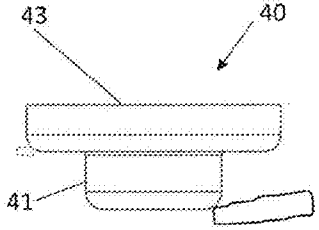
FIG. 4 is a front elevation view of the actuator of FIG. 1.

Referring to FIGS. 1-4, embodiments of a portable scrubbing and cleaning device 10 includes a cylindrical-shaped housing 20 which has a threaded uppermost end 21 and a lowermost end 23. A threaded top cap 30 connects to the uppermost end 21 of the housing 20 and includes a brush 31. The housing 20 also can include an eyelet 27 and a ring 29.

Brush 31 has a conical-shaped cleaning solution passageway 35 that passes through the bed 33 of the brush 31. A lower end 37 of the passageway 35 is sized so that a nozzle end 61 of an aerosol canister 60 fits snuggly into the lower end 37. The canister 60 holds a cleaning solution of a kind known in the art and appropriate to the intended cleaning application. For example, in the case of a barbecue grate the cleaning solution includes a degreaser. In the case of golf clubs, the cleaning solution consists of soap and water.

An actuator 40 is located at the lowermost end 23 of the housing 20, with a button end 41 of the actuator 40 extending past the lowermost end 23. Opposite the button end 41 is a pocket 43 sized to receive a bottom end 63 of the aerosol canister 60. When the button end 41 is pressed by a user, the actuator 40 moves between a normal (non-deployed) position and a depressed (deployed) position.

When in the depressed position, the linear distance 45 between the actuator 40 and the top cap 30 shortens. This causes the aerosol canister 60 to move toward the top cap 30 so that the nozzle end 61 of the aerosol canister 60 deploys to release cleaning solution into the passageway 35 and onto the brush 31. When the button end 41 is released by the user, the nozzle end 61 forces the actuator 40 back into its normal position.

To retain the actuator 40 within the housing 20, a bottom cap 50 connects to the lowermost end 23 of the cylindrical-shaped housing 20. The bottom cap 50 includes an opening 51 sized to receive the actuator 40 and allow its button end 41 to extend past the cap 50.

The brush 31 is preferably arranged at an oblique angle relative to a central longitudinal axis 11 of the housing 20 and is sized, and is of a material, appropriate to the intended cleaning application. For example, in the case of a barbecue grate, the brush 31 may be a brass-type material. In the case of a golf club, the brush 31 may be a nylon-type material and sized about 1-inch wide by 1½-inches long. The brush 31 can be a permanent part of the top cap 30—in which case different caps 30 are used to provide different brushes 31—or the brush 31 can be removed from the cap 30 and replaced with a different brush 31.

To assemble the device 10, a user removes the top cap 30, places an aerosol canister 60 into the housing 20, then tightens the top cap 30. Once assembled, the button end 41, nozzle end 61, and passageway 35 are in coaxial alignment with one another and a portion of the nozzle end 61 is inside the lower end 37 of the passageway 35.

Figure 5:
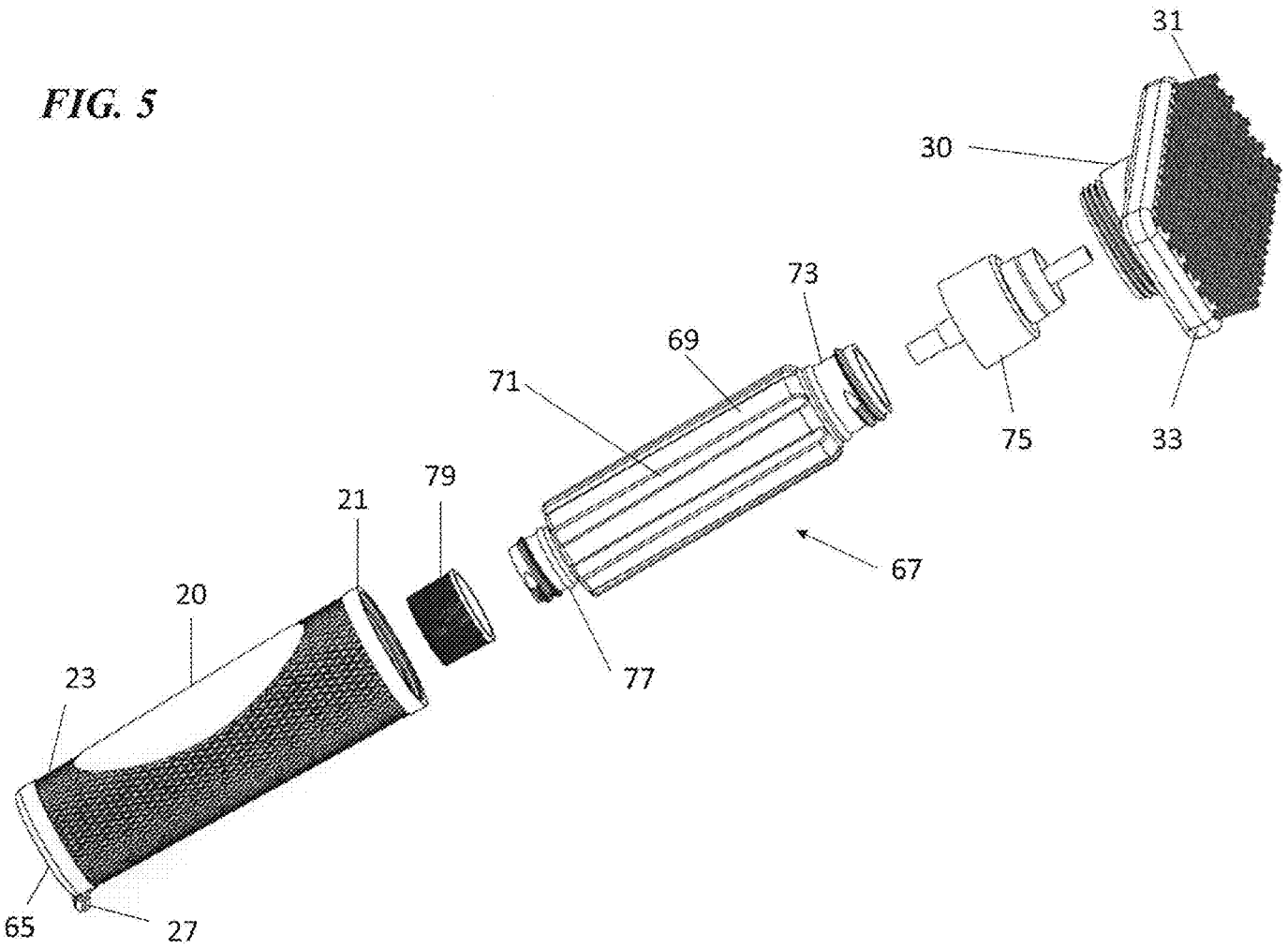
FIG. 5 is an exploded assembly view of the an embodiment of a portable scrubbing and cleaning device. The device includes a bottle with slots that correspond to fins of the housing. See FIG. 8.
Figure 7:
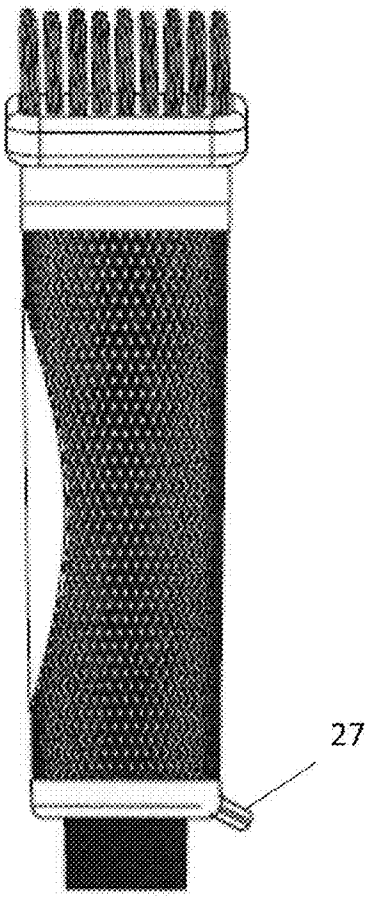
FIG. 7 is a side elevation view of the device of FIG. 6.
Figure 6:
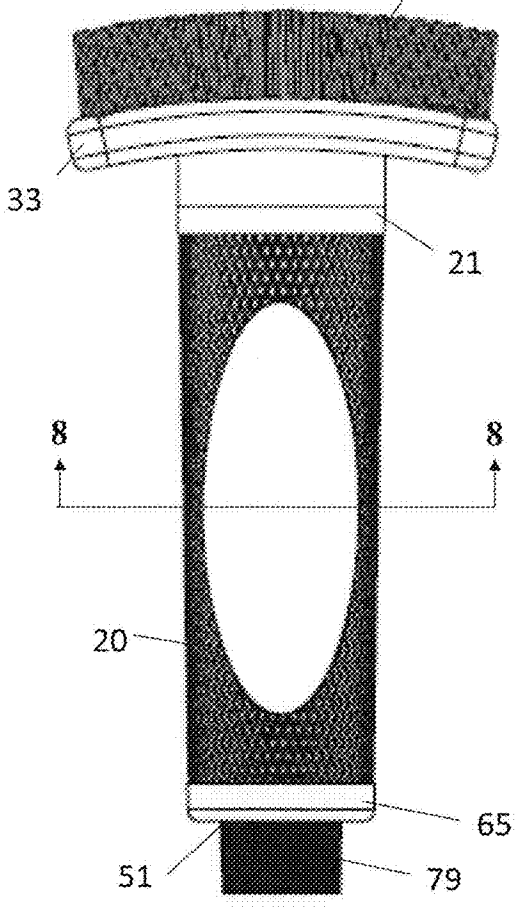
FIG. 6 is a front elevation view of an embodiment of a portable scrubbing and cleaning device when in an assembled state. The device includes a rounded or arcuate-shaped brush head.
Figure 8:
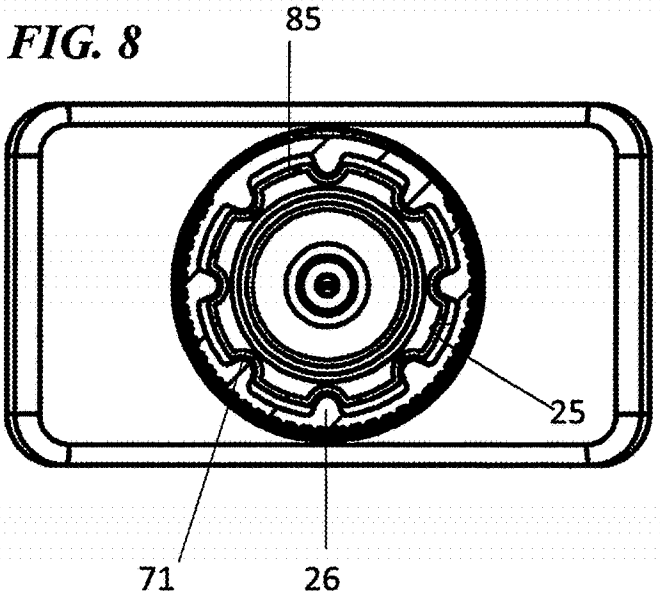
FIG. 8 is a cross section view of the device taken along section line 8-8 of FIG. 6.
Figure 9:
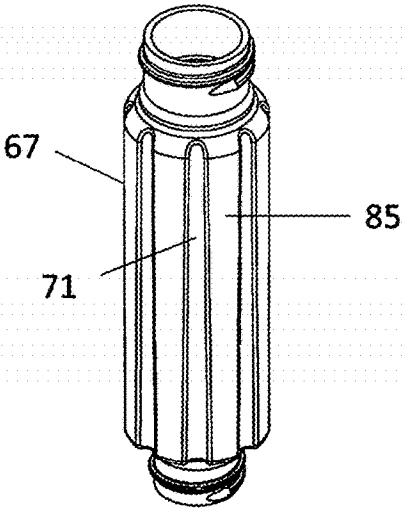
FIG. 9 is an isometric view of an embodiment of the slotted bottle or canister.
Figure 10:
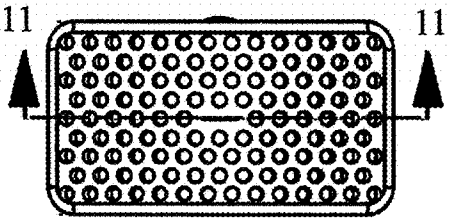
FIG. 10 is a top plan view of the embodiment of FIG. 6.
Figure 11B:
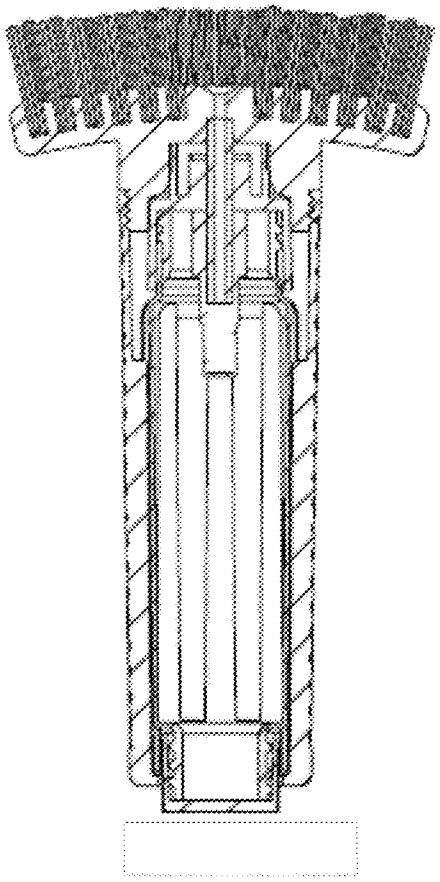
FIG. 11B is a cross section view of the device of FIG. 6 taken along section line 11-11 of FIG. 10, showing the device in the deployed position.
Figure 11A:
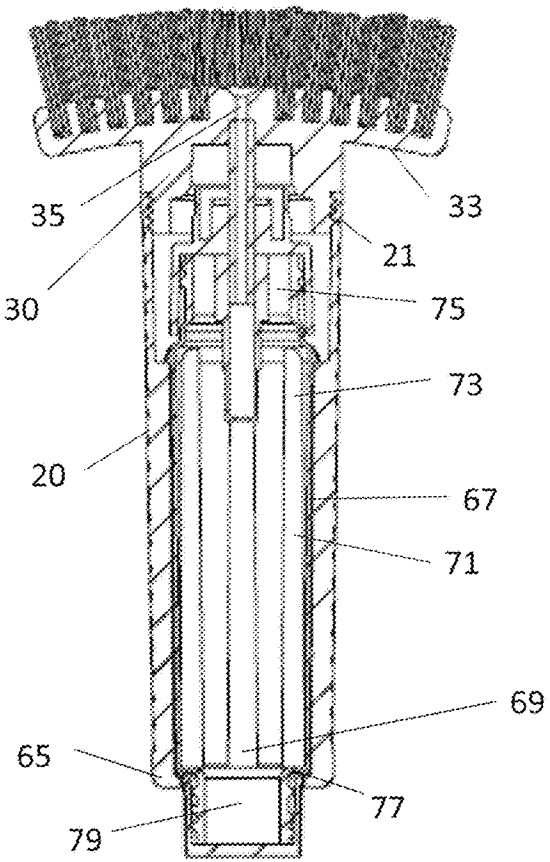
FIG. 11A is a cross-section view of the device of FIG. 6 taken along section line 11-11 of FIG. 10, showing the device in the non-deployed position.

Referring to FIGS. 5-11B, other embodiments of a portable scrubbing and cleaning device 10 of this disclosure include an elongated, cylindrical-shaped housing 20 having fins 26 and a bottle or canister 67 with corresponding slots 71. The housing 20 may include a threaded uppermost end 21 and a threaded lowermost end 23. A threaded top cap 30, which may be rounded or arcuate-shaped, connects to the uppermost end 21 of the housing 20 and includes a brush 31, with bristles distributed along a bed 33. A threaded bottom cap 65 connects to the lowermost end 23 of the housing 20

The cylindrical-shaped housing 20 is sized to contain a spray bottle 67 with a reservoir 69. The sides 85 of the spray bottle may be smooth (not shown) or include a plurality of longitudinally extending, spaced-apart channels, grooves, or slots 71, each sized to receive a corresponding projection or fin 26 located along an inner wall 25 of the housing. The fin 26 prevents rotation of the spray bottle 67. In some embodiments, there is a fewer number of fins 26 than slots 71. The fin 26 may extend an entire length of the slot 71 or may extend only a portion of the slot 71. In other embodiments, the slots 71 and fin or fins 26 are reversed, with the bottle 67 containing the fins 26 and the housing 20 containing the slots 71.

The reservoir 69 of the spray bottle 67 holds a cleaning solution of a kind known in the art and appropriate to the intended cleaning application. For example, in the case of a barbecue grate the cleaning solution includes a degreaser. In the case of golf clubs, the cleaning solution consists of soap and water. The reservoir 69 can be re-filled with the same or different cleaning solutions, depending upon the circumstances and the desired application.

The upper end 73 of the spray bottle 67, which is closer to the brush 31 end of the device 10, has a threaded opening that is sealed with a spray pump 75. One portion of the spray pump 75 extends into the reservoir 69 of the spray bottle 67, while the opposite portion of the spray pump 75 extends through the top cap 30 of the device 10 and into the brush 31. This creates a cleaning solution passageway 35 from the reservoir 69 of the spray bottle 67 through the spray pump 75 and the bed 33 of the brush 31 to the bristles. The lower end 77 of the spray bottle 67 has a threaded opening that may be sealed with a threaded spray bottle cap 79.

The bottom cap 65 of the scrubbing and cleaning device 10 includes an opening 51 sized to receive the threaded spray bottle cap 79. When the device is assembled, the threaded spray bottle cap 79 extends past the lowermost end 23 of the housing 20 and through the bottom cap 65 of the device 10. When the spray bottle cap 79 of the spray bottle 67 is pressed by a user, the spray bottle 67 moves between a normal (non-deployed) position and a depressed (deployed) position. When in the depressed position, the linear distance between the spray bottle cap 79 and the top cap 30 of the device 10 shortens. This causes the spray bottle 67 to move toward the top cap 30 so that the spray pump 75 of the spray bottle 67 deploys to release cleaning solution into the cleaning solution passageway and onto the brush 31. When the spray bottle cap 79 is released by the user, the spray pump 75 forces the spray bottle 67 back into its normal position.

The brush 31 may be arranged at an oblique angle relative to a central longitudinal axis of the housing 20 and is sized, and is of a material, appropriate to the intended cleaning application. For example, in the case of a barbecue grate, the brush 31 may be a brass-type material. In the case of a golf club, the brush 31 may be a nylon-type material and sized about 1-inch wide by 1-½-inches long. The brush 31 can be a permanent part of the top cap 30—in which case different caps 30 are used to provide different brushes 31—or the brush 31 can be removed from the cap 30 and replaced with a different brush 31. The device 10, and its brush 31, is intended for use in cleaning metallic objects such as barbecue grates, golf clubs, and automotive wheels. The device 10 is not intended for use in cleaning tooth enamel, porcelain, or ceramic surfaces.

To assemble the device 10, a user threads the bottom cap 65 onto the lowermost end 23 of the cylindrical-shaped housing 20. The user then seals the lower end 77 of the spray bottle 67 with the spray bottle cap 79, fills the spray bottle 67 with an appropriate cleaning solution, threads the spray pump 75 onto the upper end 73 of the spray bottle 67, and places the spray bottle 67 inside the housing 20, ensuring that the spray bottle cap 79 extends through the opening in the bottom cap 65 of the device 10. The user then screws the threaded end of the top cap 30 of the device 10 onto the uppermost end 21 of the cylindrical-shaped housing 20. Once assembled, the spray bottle cap 79, spray pump 75, and cleaning solution passageway are in coaxial alignment with one another and a portion of the spray pump 75 is inside the bed 33 of the brush 31 adjacent to the bristles.

Embodiments of the device 10 are sized to fit in user's hand so that it may be gripped between the palm and fingers during use, with the brush bed 33 extending past one side of the closed hand and the spray bottle cap 79 extending past the other side of the closed hand. The overall height of device 10—from the top of the brush bed 33 to the bottom of the actuator cap 79 may be in a range of 5 inches to 6 inches. In some embodiments, the spray bottle cap 79 may extend about 0.5 inches from the bottom cap 65.

The brush bed 33 may be rectangular in shape having a length greater than a diameter of the housing 20 and a width greater than the diameter of the housing 20. See e.g. FIGS. 8 and 10. The bed 33 may also be arcuate-shaped. In some embodiments, the arcuate-shape is in a range of a 6½ to 7¼ inch radius. For example, in one embodiment the upper surface of the bed 33 has about a 7-inch radius and the lower surface has a radius in a range of 6⅝ to 6¾ inches. In some embodiments, the width of the bed 33 is in a range of 1½ to 2 inches. The diameter of the housing 20 may be in a range of 1 to 1¾ inches (depending on bed width). The brushes 31 may be about 0.018 inches in diameter and about 0.5 inches in length; in other embodiments the brushes 31 may be longer and softer.

While the embodiments have been described by way of example, a portable scrubbing and cleaning device of this disclosure is defined by the following claims, including the full range of equivalents to which the recited claim elements are entitled.

What is claimed:

1. A portable scrubbing and cleaning device comprising:

an elongated, cylindrical-shaped housing including a threaded uppermost end, a threaded lowermost end including an opening, and at least one fin located along an inner sidewall of the housing;

an elongated, cylindrical-shaped canister slidably received by and removable from the housing, the canister including a cleaning solution reservoir and at least one slot located along an outer sidewall of the canister, the slot sized to receive the at least one fin of the housing;

an arcuate-shaped top cap threadably connectable to the threaded uppermost end of the housing, the top cap containing a brush bed arranged concentric to a central longitudinal axis of the housing and a cleaning solution passageway in fluid communication with the brush bed and an upper end of the canister; and an actuator at least partially contained within the opening of the lowermost end of the housing and arranged to move the canister toward the top cap, a linear distance between the actuator and the top cap being greater when the actuator is in a non-deployed position than when in a deployed position;

the canister including a threaded lower end;

the actuator including a threaded cap threadably connectable to the threaded lower end of the canister.

2. The device of claim 1, the canister further including a spray pump located at the upper end of the canister, the spray pump at least partly contained within the top cap.

3. A portable scrubbing and cleaning device comprising:

an elongated, cylindrical-shaped housing including a removable lowermost end having an opening and at least one fin located along an inner sidewall of the housing;

an elongated, cylindrical-shaped shaped canister slidably received by and removable from the housing, the canister including a cleaning solution reservoir and at least one slot located along an outer sidewall of the canister, the slot sized to receive the at least one fin of the housing;

a top cap connectable to an uppermost end of the housing, the top cap including a brush bed containing brushes extending away from the top cap and a cleaning solution passageway in fluid communication the brush and an upper end of the canister; and an actuator at least partially contained within the removable lowermost end of the housing and a remaining portion extending outward past the opening, the actuator arranged to move the canister toward the top cap when a force is applied to the actuator;

the canister including a threaded lower end;

the actuator including a threaded cap threadably connectable to the threaded lower end of the canister.

4. The device of claim 3, the top cap including an arcuate-shaped brush bed arranged concentric to a central longitudinal axis of the housing.

5. The device of claim 3, the top cap being arranged at an oblique angle relative to a central longitudinal axis of the housing.

6. The device of claim 3, the canister further including a spray pump located at the upper end of the canister, the spray pump at least partly contained within the top cap.

7. The device of claim 3, the housing including an eyelet.

8. The device of claim 3, the housing including a diamond patterned knurled finish.

* * * * *